US008579270B1

(12) United States Patent
Hansen et al.

(10) Patent No.: US 8,579,270 B1
(45) Date of Patent: Nov. 12, 2013

(54) BODY JEWELRY TOOL

(76) Inventors: Elisha M. Hansen, Issaquah, WA (US); Mark Steves, Issaquah, WA (US)

( * ) Notice: Subject to any disclaimer, the term of this patent is extended or adjusted under 35 U.S.C. 154(b) by 622 days.

(21) Appl. No.: 12/860,522

(22) Filed: Aug. 20, 2010

(51) Int. Cl.
*B25B 5/16* (2006.01)

(52) U.S. Cl.
USPC ..... 269/6; 269/3; 29/255; 29/270; 29/278

(58) Field of Classification Search
USPC ..... 29/244, 270, 278, 255, 283; 269/3, 6, 269/95; 254/25, 21, 19
See application file for complete search history.

(56) References Cited

U.S. PATENT DOCUMENTS

| | | | | |
|---|---|---|---|---|
| 3,029,502 | A * | 4/1962 | Middaugh | 29/245 |
| 3,261,238 | A | 7/1966 | Amerling | |
| 3,529,497 | A * | 9/1970 | Brooks | 81/463 |
| 3,862,483 | A * | 1/1975 | Kloster | 29/257 |
| 4,744,552 | A | 5/1988 | Glaser | |
| 5,090,102 | A * | 2/1992 | Lovell | 29/255 |
| 5,355,574 | A * | 10/1994 | Zweekly et al. | 29/262 |
| 5,784,900 | A | 7/1998 | Czupryniak | |
| 5,875,534 | A * | 3/1999 | Jackson | 29/255 |
| 5,890,271 | A * | 4/1999 | Bromley et al. | 29/263 |
| 6,293,925 | B1 | 9/2001 | Safabash et al. | |
| 6,308,934 | B1 * | 10/2001 | Gallo | 254/25 |
| 6,622,522 | B2 | 9/2003 | Abramson et al. | |
| 7,343,760 | B2 | 3/2008 | Tyler | |
| 8,166,624 | B2 * | 5/2012 | Andreasen et al. | 29/254 |
| 2006/0090509 | A1 | 5/2006 | Jones et al. | |
| 2007/0187440 | A1 | 8/2007 | Rosenbaum et al. | |

OTHER PUBLICATIONS

Small Curving Pliers with Sharp Cutting Edge. Steel Navel. http:www.steelnavel.com/product.asp?ID-866&MID=44&gad=CIOc8uUDEgh7nRfGP4mSqBjv1bv_AyDfmdsv&gkw=866. Accessed Apr. 30, 2010.

* cited by examiner

*Primary Examiner* — Lee D Wilson
(74) *Attorney, Agent, or Firm* — Robert C. Montgomery; Montgomery Patent & Design

(57) ABSTRACT

A body jewelry tool to aid in the application and removal of body piercing retaining fasteners comprises a tubular body of non-corroding stainless steel for a long life and ease of cleaning for sanitary use. The outer surface comprises a rubberized grip. An operational end of the device comprises an internal grasping mechanism that readily adapts to all sizes of threaded ball fasteners used as retainers on body piercings. In such a manner, the user or wearer can hold the jewelry in one hand while the tool is used to grasp and hold the retaining ball with the other hand. The device is then easily turned to remove or install the ball as necessary.

19 Claims, 3 Drawing Sheets

BODY JEWELRY TOOL

RELATED APPLICATIONS

The present invention was first described in a notarized Official Record of Invention on Apr. 13, 2009, that is on file at the offices of Montgomery Patent and Design, LLC, the entire disclosures of which are incorporated herein by reference.

FIELD OF THE INVENTION

The present invention relates generally to jewelry tools, and more particularly, to a tool for grasping a spherical retainer used for body jewelry.

BACKGROUND OF THE INVENTION

The practice of body piercing has evolved from a simple fashion accessory to a means to make a personal statement. No longer are only ears pierced, it is now common place to see noses, tongues, lips, faces, chests, belly buttons, nipples, and even sex organs pierced in a continuing pursuit of individual expression. As body piercing has become more of a fashion statement, a vast variety of specially crafted jewelry has become available. While materials also vary widely, widespread use of surgical steel has become the most common material used to produce body jewelry.

Several devices have addressed the difficulties of performing the piercing of various body parts; however users must still remove and attach the body jewelry by hand. Typically body jewelry includes a labret stud, a straight post, or a captive ring which are held in place with a ball-shaped retainer attached to one end. The retainers are usually five-thirty seconds (5/32) of an inch in diameter and are extremely difficult to hold while attempting to remove from or apply to the threaded stem of the jewelry. This difficulty increases when the jewelry is at awkward angles, there is poor lighting, or when the retainer becomes wet and slippery.

SUMMARY OF THE INVENTION

In view of the current lack in the art and the inherent problems, the inventor has recognized the need for a device to simply and efficiently grip a ball-shaped retainer during application to and removal from body jewelry and thus, the object of the present invention is to solve the aforementioned disadvantages and development of the present invention substantially departs from the conventional solutions and in doing so fulfills this need.

Another object of the present invention is to provide a device which can easily and effectively adapted to grasp various sizes of spherical body jewelry retainers.

Another object of the present invention is to provide a device which allows for quick removal and application of body jewelry, particularly in inaccessible locations.

Another object of the present invention is to provide a device which is can be readily sanitized.

Yet another object of the present invention is to provide a device which has an extended useful life.

Yet another object of the present invention is to provide a device which is simple and intuitive to use with little to no training.

Yet another object of the present invention is to provide a device which is durable and economical to manufacture.

One (1) or more of these and other objects of the invention are achieved by a body jewelry tool adapted to fit comfortably within a hand of a user comprising a base sleeve having a cylindrical interior, a closed bottom end, and an open top end; a grasping mechanism having a substantially cylindrical grasping shaft extending from the base sleeve with a prehensile end and an affixed end attached to the base sleeve closed bottom; a substantially cylindrical outer sleeve slidably disposed over the grasping mechanism having an open top end and an open bottom end; and a helical compression spring disposed within the base sleeve interior and around a lower portion of the grasping shaft affixed between the base sleeve closed bottom end and the outer sleeve open bottom end. The outer sleeve having a first position and a second position having a reciprocating motion provided by the spring. An interior of the outer sleeve open top being sized smaller than an exterior of the prehensile end, such that the outer sleeve open top end applies a radially inward compressive force to the prehensile end when the outer sleeve is in the first position and applied over the prehensile end. The prehensile end is provided in a closed position when the outer sleeve is in the first position and in an open position when the outer sleeve is in the second position. The tool is intended to secure a spherical retainer of a piece of body jewelry within the prehensile end when in the closed position for threadingly attaching to and removing from a threaded stem of the body jewelry.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | body jewelry tool |
| 12 | reciprocating motion |
| 15 | body jewelry |
| 16 | retainer |
| 20 | base sleeve |
| 30 | finger engaging means |
| 32 | palm engaging means |
| 40 | outer sleeve |
| 42 | outwardly tapered end |
| 50 | grasping mechanism |
| 51 | affixed end |
| 52 | prehensile end |
| 53 | deformable tabs |
| 55 | grasping mechanism shaft |
| 56 | gripping surface |
| 57 | coupling means |
| 60 | spring |
| 70 | digit |

DETAILED DESCRIPTION OF THE PREFERRED EMBODIMENT

Figure 1:
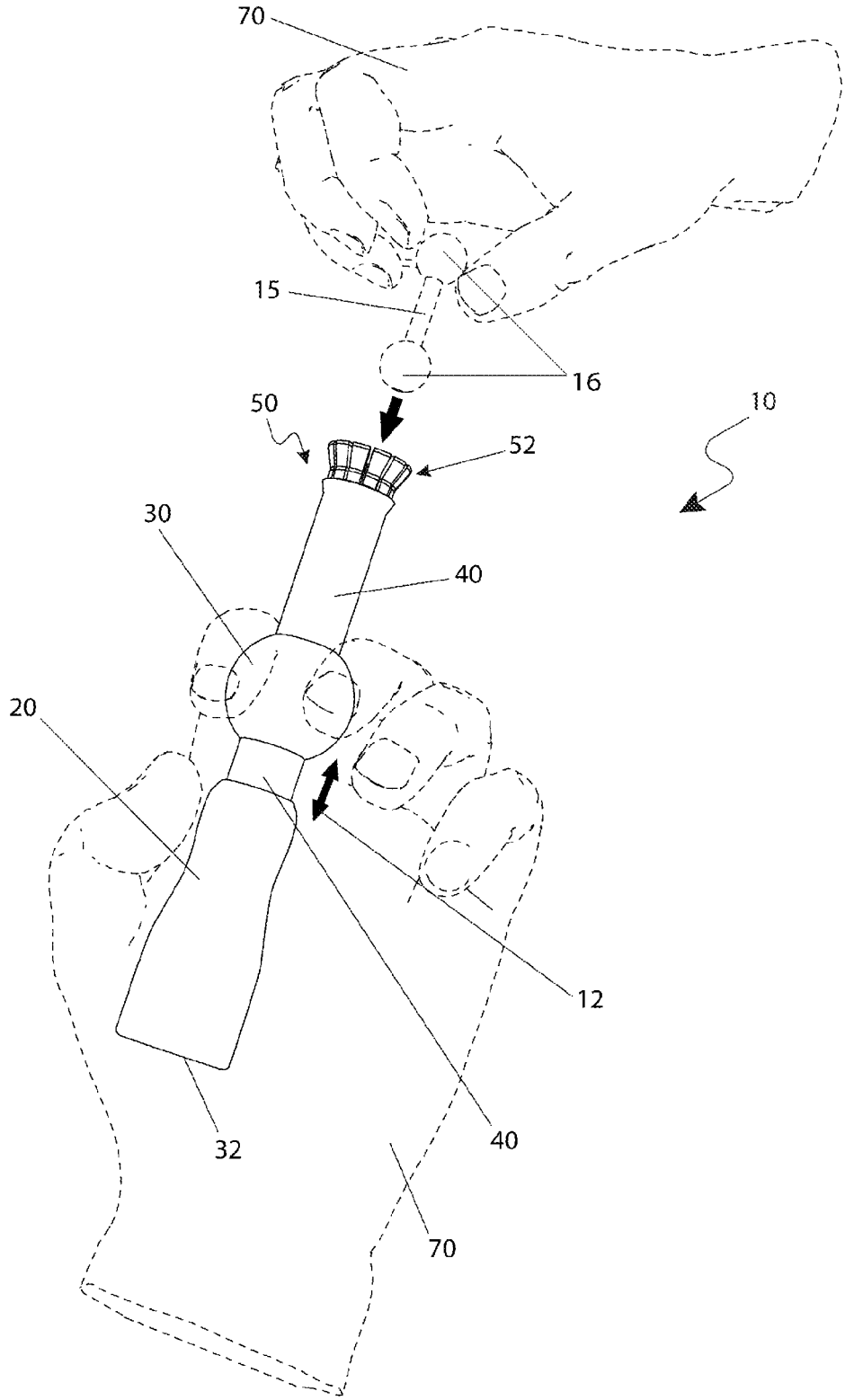
FIG. 1 is a perspective view of a body jewelry tool 10, according to a preferred embodiment of the present invention.
Figure 2:
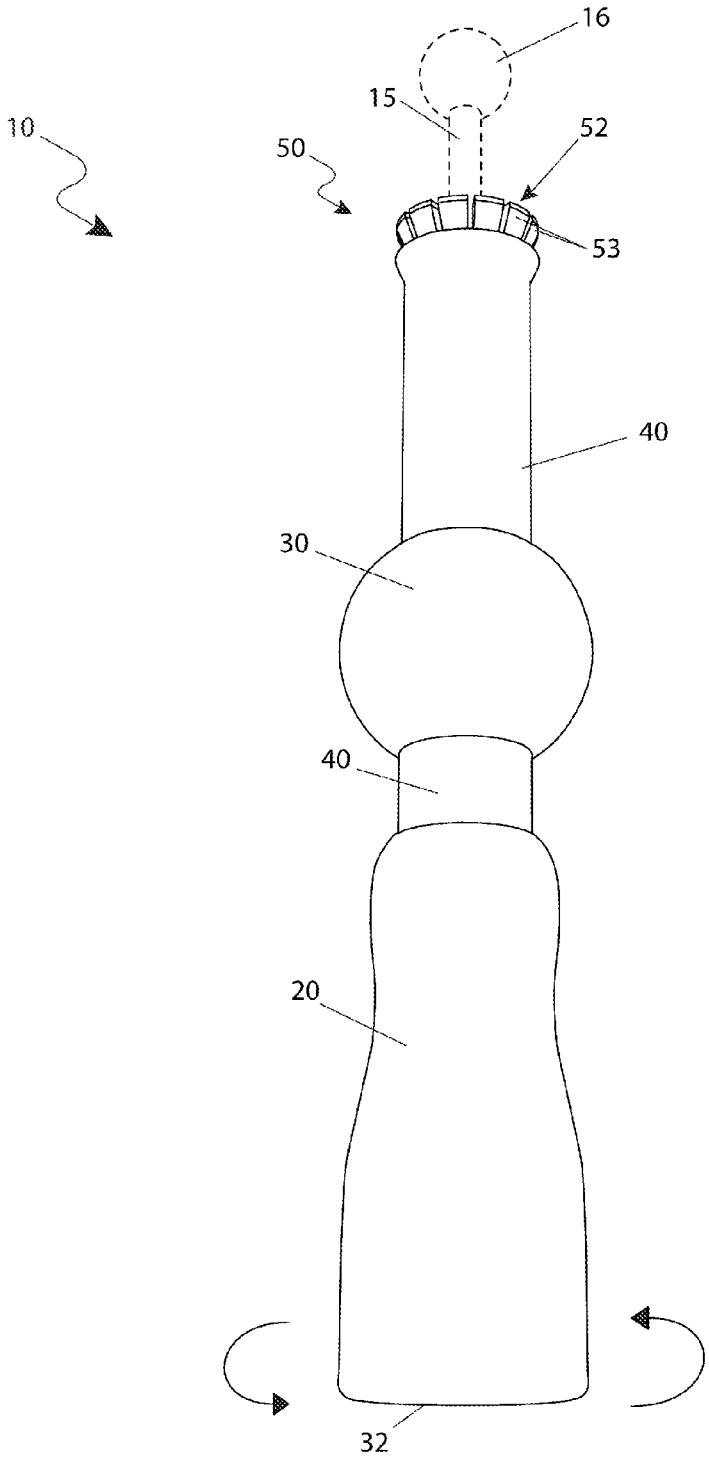
FIG. 2 is another perspective view of the body jewelry tool 10 depicting an in-use state, according to a preferred embodiment of the present invention; and, FIG. 3 is a cut away view of the body jewelry tool 10, according to a preferred embodiment of the present invention.
Figure 3:
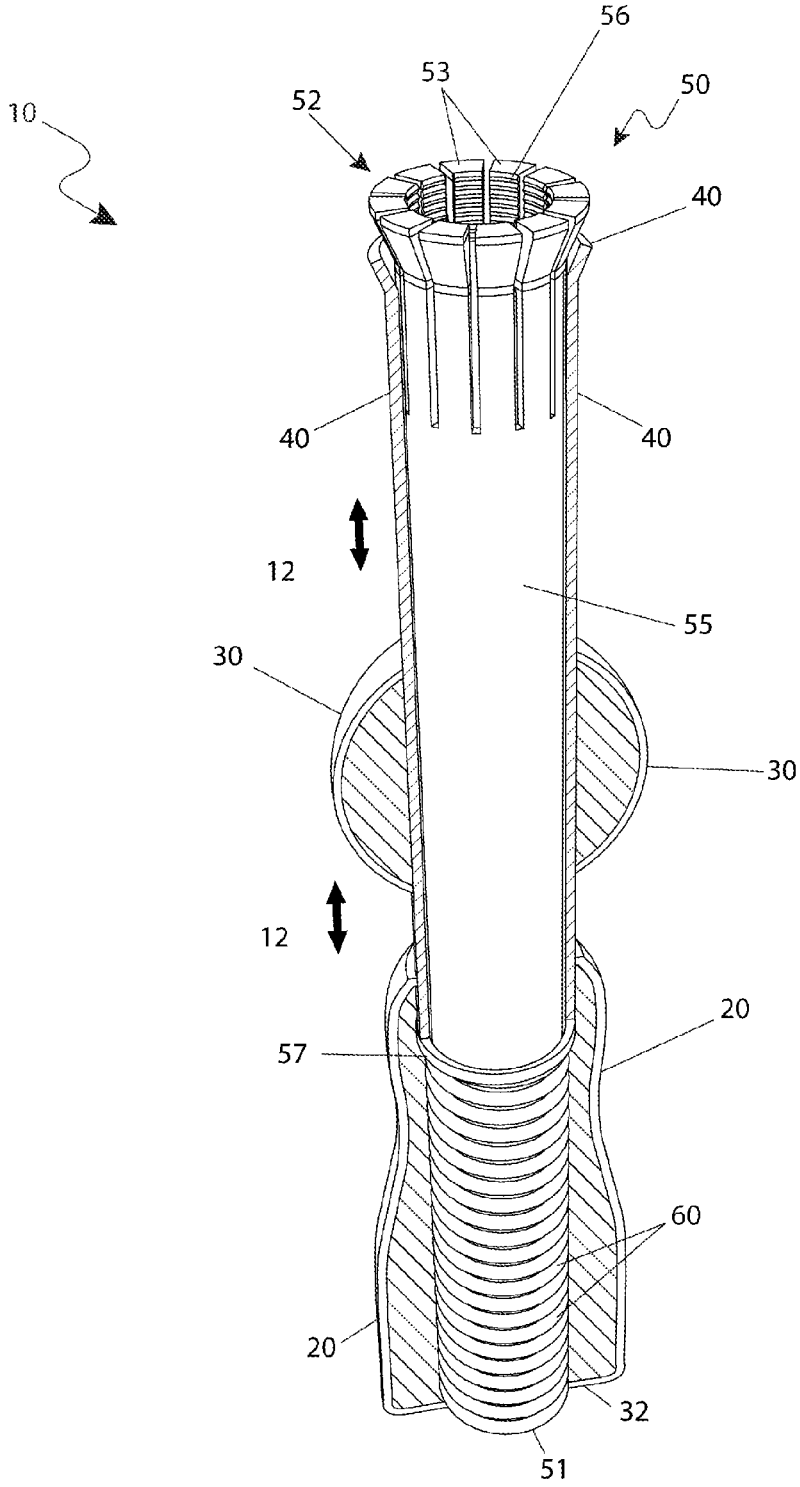

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a body jewelry tool (herein described as the "device") 10, which provides a means to assist in the donning and removal of conventional body jewelry 15. The body jewelry 15 comprising at least one (1) spherical retainer 16 utilized to secure the body jewelry 15 to a desired body part on a wearer. The device 10 comprises a base sleeve 20, a finger engaging means 30, a palm engaging means 32, an outer sleeve 40, and a grasping mechanism 50. The device 10 comprises dimensions suited to comfortably fit in a user's hand, preferably approximately four (4) inches in length and a one-half (½) an inch in diameter. The device 10 is preferably fabricated from a noncorrosive stainless steel enabling the device 10 to be sanitary, yet other materials may be used without limiting the scope of the device 10. The device 10 is adaptable to various gauges of body jewelry 15.

Referring now to FIG. 1, a perspective view of the device 10 and FIG. 2, another perspective view of the device 10 depicting an in-use state, according to the preferred embodiment of the present invention, are disclosed. The device 10 comprises a generally cylindrical form. The base sleeve 20 is located on a proximal portion of the device 10, the finger engaging means 30 is located on an intermediate portion, and the grasping mechanism 50 is located on a distal portion. The base sleeve 20 comprises a tubular member having a contoured, generally hourglass-shaped, exterior profile, a cylindrical interior recess, and a closed bottom. The outer sleeve 40 comprises a tubular member and is slidingly attached within the base sleeve 20; the base sleeve 20 having an interior recess diameter sized slightly larger than an exterior diameter of the outer sleeve 40. The finger engagement means 30 comprises a spherical body affixed around an intermediate portion of the outer sleeve 40. The finger engagement means 40 is preferably made of a rubber material. A helical spring 60 is affixed between the closed bottom end of the base sleeve 20 and a lower end of the outer sleeve 40 to provide a reciprocating motion 12 to the outer sleeve 40 with respect to the base sleeve 20. The lower end of the outer sleeve 40 is affixed to a top end of the spring 60 via a coupling means 57. The coupling means 57 is preferably a flat washer having in inner diameter sized to fit around the grasping mechanism shaft 55.

The grasping mechanism 50 comprises a grasping shaft 55 having an affixed end 51 and a prehensile end 52 opposite the affixed end 51. The affixed end 51 of the grasping shafted 55 is rigidly affixed to the bottom end of base sleeve 20 and is disposed within an open interior of the spring 60. The prehensile end 52 comprises a plurality of resilient and deformable tabs 53 having an open position and a closed position. The plurality of tabs 53 have arcuate ends and are circumferentially positioned relative to each other. The open position is produced when the outer sleeve 40 is depressed into the base sleeve 20, thus allowing the plurality of tabs 53 to expand to a natural position. The closed position is produced when the outer sleeve 40 is expanded by the spring 60 back to an original position. An upper open end of the outer sleeve 40 further comprises an outwardly tapered end 42 which exerts a compressive force upon the plurality of tabs 53 in order to contract and close. An inner surface of each of the plurality of tabs 53 further comprises a gripping surface 56. The gripping surface 56 comprises a texture, a plurality of contours, or a material which provides a high level of friction between the gripping surface 56 and the exterior of the retainer 16. In a preferred embodiment the prehensile end 52 comprises a split collet type of clamping chuck which forms a collar around the retainer ball 16 of the body jewelry 15. However, it is understood by those skilled in the art that other forms of clamping mechanisms are suitable for the prehensile end 52.

In use, the device 10 is held in the hand of the user with the palm engaging means 20 making contact with lower portion of the palm of the user, preferably near the base of the thumb, and at least two fingers in contact with the finger engaging means 30. When the fingers are drawn toward the palm the outer sleeve 40 moves in an upward and downward reciprocating motion 12 as the outer sleeve 40 is depressed which internally compresses the spring 60. The depressed outer sleeve 40 exposes the prehensile end 52 and places the plurality of tabs 53 in the open position. The retainer 16 is inserted into the center of the expanded plurality of tabs 53 and the outer sleeve 40 is allowed to return to the original position where the upper open end of the outer sleeve 40 contracts the plurality of tabs 53, thus grasping the retainer 16. Once the detachable retainer 16 has been secured within the prehensile end 52, the user preferably grips the device 10 at the finger engaging means 30 and rotates the device 10 clockwise or counterclockwise to remove or attach the retainer 16 from the body jewelry 15.

Referring now to FIG. 3, a cut-away view of the device 10, according to the preferred embodiment of the present invention, is disclosed. The preferred internal layout of the device 10 can be best seen in this view. The helical compression spring 60 is attached to the closed bottom of the base sleeve 20 with fastening means such as, but not limited to: interference fitting, integral molding, adhesive, or the like. The spring 60 engages the outer sleeve 40 via the coupling means 57 enabling the spring 60 to compress against the lower end of the outer sleeve 40, thus exerting a force against the outer sleeve 40 to return to an expanded position and concurrently contracting the prehensile end 52 inwardly in a radial direction. Such compression enables the prehensile end 52 to grasp the retainer 16 of the piece of body jewelry 15.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3.

The method of utilizing the device 10 may be achieved by performing the following steps: acquiring the device 10; positioning the device 10 such that the palm engaging means 32 is in contact with the user's palm and the finger engaging means 30 is in contact with the user's fingers; engaging the fingers engaging means 30 and depressing the outer sleeve 40, thereby compressing a spring 60 between the outer sleeve 40 and the bottom of the base sleeve 20, thus concurrently exposing the prehensile end 52 of the grasping mechanism 50; inserting the retainer 16 portion of a desired body jewelry 15 into the expanded plurality of deformable tabs 53 of the prehensile end 52; disengaging the finger engaging means 30, thereby expanding the spring 60 and returning the outer sleeve 40 to an original position, thus concurrently closing the plurality of deformable tabs 53 around the retainer 16 to simultaneously grasp the retainer 16 and retract the grasping mechanism 50; rotating the device 10 clockwise or counter clockwise, preferably by holding the finger engaging means 30, to attach or remove the retainer 16, respectively; removing or donning the body jewelry 16 from the user; engaging the fingers engaging means 30 and depressing the outer sleeve 40, thus concurrently exposing the prehensile end 52 of the grasping mechanism 50; and, releasing the retainer 16.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A body jewelry tool comprising:

a base sleeve having a cylindrical interior;

a cylindrical grasping mechanism extending from within said base sleeve interior having a prehensile end for securing a spherical retainer for body jewelry, said prehensile end having an open position and a closed position;

a substantially cylindrical outer sleeve slidably disposed over said grasping mechanism, said outer sleeve having a first position and a second position; and, a reciprocating means for providing a reciprocating motion to said outer sleeve between said first position and said second position along said grasping mechanism;

wherein an interior of an open top end of said outer sleeve being sized smaller than an exterior of said prehensile end, such that said outer sleeve open top end applies a radially inward compressive force to said prehensile end when said outer sleeve is in said first position and applied over said prehensile end;

wherein said tool is adapted to fit comfortably within a hand of a user; and, whereby said spherical retainer is secured within said prehensile end in said closed position for threadingly attaching to and removing from a threaded stem of said body jewelry.

2. The tool of claim 1, wherein said base sleeve further comprises a closed bottom end and an open top end opposite said closed bottom end; and, wherein said outer sleeve further comprises an open bottom end opposite said outer sleeve open top end.

3. The tool of claim 1, wherein said grasping mechanism further comprises a grasping shaft having an affixed end opposite said prehensile end, said affixed end being rigidly connected to a closed bottom of said base sleeve.

4. The tool of claim 1, wherein said reciprocating means further comprises:

a spring disposed within said base sleeve interior, said spring being affixed between said outer sleeve open bottom end and said base sleeve closed bottom end by a coupler.

5. The tool of claim 4, wherein a lower end of said grasping shaft is disposed within said base sleeve interior and within an open interior of said spring.

6. The tool of claim 5, wherein said reciprocating means further comprises:

a finger engaging means for engagement by at least two fingers of a user; and, a palm engaging means for engagement by a palm of a user;

wherein said at least two fingers provide a downward force upon said finger engaging means to depress said outer sleeve with respect to said base sleeve; and, wherein said palm provides an upward force upon said palm engaging means to depress said base sleeve with respect to said outer sleeve.

7. The tool of claim 6, wherein said finger engaging means comprises a spherical member affixed around an intermediate position of said outer sleeve.

8. The tool of claim 7, wherein said palm engaging means comprises a contoured exterior surface of said base sleeve closed bottom end.

9. The tool of claim 1, wherein said prehensile end further comprises a plurality of deformable tabs comprising arcuate ends which are circumferentially positioned relative to one another.

10. A body jewelry tool comprising:

a base sleeve comprising a cylindrical interior, a closed bottom end, and an open top end opposite said closed bottom end;

a grasping mechanism comprising a substantially cylindrical grasping shaft extending from said base sleeve interior having a prehensile end and an affixed end opposite said prehensile end, said affixed end being attached to said base sleeve closed bottom;

a substantially cylindrical outer sleeve slidably disposed over said grasping mechanism comprising an open top end and an open bottom end opposite said open top end, said outer sleeve having a first position and a second position; and, a helical compression spring disposed within said base sleeve interior and around a lower portion of said grasping shaft, said spring being affixed between said base sleeve closed bottom end and said outer sleeve open bottom end by a coupler for providing a reciprocating motion to said outer sleeve;

wherein an interior of said outer sleeve open top being sized smaller than an exterior of said prehensile end, such that said outer sleeve open top end applies a radially inward compressive force to said prehensile end when said outer sleeve is in said first position and applied over said prehensile end;

wherein said prehensile end further comprises a closed position when said outer sleeve is in said first position and an open position when said outer sleeve is in said second position;

wherein said tool is adapted to fit comfortably within a hand of a user; and, whereby a spherical retainer is secured within said prehensile end in said closed position for threadingly attaching to and removing from a threaded stem of body jewelry.

11. The tool of claim 10, wherein said prehensile end further comprises a plurality of deformable tabs comprising arcuate ends which are circumferentially positioned relative to one another.

12. The tool of claim 11, wherein said outer sleeve further comprises a finger engaging means comprising a spherical member affixed around an intermediate position of said outer sleeve for engagement by at least two fingers of said user;

wherein said at least two fingers provide a downward force upon said finger engaging means to depress said outer sleeve with respect to said base sleeve.

13. The tool of claim 12, wherein said base sleeve further comprises a palm engaging means comprising an exterior surface of said base sleeve closed bottom end for engagement by a palm of said user;

wherein said palm provides an upward force upon said palm engaging means to depress said base sleeve with respect to said outer sleeve.

14. The tool of claim 13, wherein said plurality of deformable tabs each further comprises a textured gripping surface on an interior side.

15. The tool of claim 14, wherein said coupler further comprises a flat washer having a central aperture being suitably sized to fit around said grasping shaft.

16. The tool of claim 15, wherein said finger engaging means further comprises a rubber material.

17. The tool of claim 16, wherein said base sleeve further comprises a contoured exterior profile having a generally hourglass shape.

18. The tool of claim 17, wherein said prehensile end further comprises a split collet clamping chuck for forming a collar around said retainer.

19. A method of securing a spherical retainer for attaching to and removing from a threaded stem of a piece of body jewelry utilizing a body jewelry tool, comprising the steps of:

providing said body jewelry tool having a base sleeve, an outer sleeve, and a grasping mechanism, said outer sleeve having a first position and a second position;

positioning said tool such that a palm engaging means is in contact with a user's palm and a finger engaging means is in contact with said user's fingers;

engaging said fingers engaging means;

depressing said outer sleeve and compressing a spring between said outer sleeve and a bottom of said base sleeve;

positioning said outer sleeve in said second position, thus concurrently exposing a prehensile end of said grasping mechanism and placing a plurality of deformable tabs of said prehensile end in an open position;

inserting said retainer into said plurality of deformable tabs;

disengaging said finger engaging means and expanding said spring;

returning said outer sleeve to said first position, thus concurrently covering said prehensile end and placing said plurality of deformable tabs in a closed position around said retainer;

rotating said tool counter clockwise to remove said retainer from said stem;

applying or removing said piece of body jewelry as desired;

rotating said tool clockwise to attach said retainer to said stem;

engaging said fingers engaging means and depressing said outer sleeve, thus concurrently exposing said prehensile end and placing said plurality of deformable tabs in said open position; and, releasing said retainer.

* * * * *